US008002118B2

(12) United States Patent
Tratar et al.

(10) Patent No.: US 8,002,118 B2
(45) Date of Patent: Aug. 23, 2011

(54) POCKET SELECTOR GATE WITH SELF LOCKING GEOMETRY

(75) Inventors: David B. Tratar, Dearborn, MI (US); Johan P. Bakker, Brighton, MI (US); Paul J. McCarthy, Commerce, MI (US); Michael J. Kiplinger, Kalamazoo, MI (US); Thomas J. Shelton, Canton, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 26 days.

(21) Appl. No.: 12/193,064

(22) Filed: Aug. 18, 2008

(65) Prior Publication Data

US 2010/0038848 A1 Feb. 18, 2010

(51) Int. Cl.
*B07C 3/00* (2006.01)

(52) U.S. Cl. ..... 209/657; 209/653; 271/303

(58) Field of Classification Search ..... 209/583, 209/652, 653, 657; 271/303
See application file for complete search history.

(56) References Cited

U.S. PATENT DOCUMENTS

| | | | | | |
|---|---|---|---|---|---|
| 3,771,783 | A * | 11/1973 | McInerny | ..... | 271/125 |
| 3,776,546 | A * | 12/1973 | Erickson et al. | ..... | 271/303 |
| 4,518,161 | A * | 5/1985 | Nakamura | ..... | 271/303 |
| 5,711,520 | A * | 1/1998 | Hutson | ..... | 271/222 |
| 6,036,026 | A * | 3/2000 | Tranquilla | ..... | 209/592 |
| 6,152,309 | A * | 11/2000 | Price et al. | ..... | 209/657 |
| 6,981,636 | B2 * | 1/2006 | Gallo-Hendrikx | ..... | 235/379 |
| 7,334,687 | B2 * | 2/2008 | Yurko | ..... | 209/652 |
| 7,594,659 | B2 * | 9/2009 | Nishimura | ..... | 271/303 |
| 2009/0033028 | A1 * | 2/2009 | Yahata et al. | ..... | 271/259 |

* cited by examiner

*Primary Examiner* — Joseph C Rodriguez
(74) *Attorney, Agent, or Firm* — Honigman Miller Schwartz and Cohn LLP

(57) ABSTRACT

An automated document processing apparatus comprising a detector; a plurality of pockets; and a pocket selector gate assembly which causes a document being processed by the apparatus to be routed to one of the plurality of pockets based on information read from the document by the detector, the route of the document being determined by the position of a pocket selector gate, the pocket selector gate position being controlled by a motor which is mechanically coupled to the pocket selector gate, the mechanical coupling being such that, when the pocket selector gate is in a first position, the pocket selector gate is locked in place even after the motor has been deenergized. The mechanical coupling may be achieved by way of a link arm and pin, the pin mating with the link arm and engaging a mating slot of the pocket selector gate.

13 Claims, 9 Drawing Sheets

POCKET SELECTOR GATE WITH SELF LOCKING GEOMETRY

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD

The instant disclosure relates to the field of automated check and other document processing systems, and more particularly provides a pocket selector/diverter gate whose geometry locks the gate in the desired position.

BACKGROUND

In traditional document processing machines, the document is scanned, identified or characterized according to a set of rules, and routed to an appropriate bin, or pocket. In many cases, the documents are routed using a selector gate which is actuated using an electric motor or solenoid (referred to herein generally as a "motor", for clarity). The selector gate is typically spring-biased, the spring allowing the selector gate to return to a default reference position when the motor is turned off, but requiring that the motor remain energized (i.e. turned on) to move the selector gate to another position.

The use of a spring-biased selector gate necessitates that larger motors be employed within the document processing systems, because the motors must overcome not only the inertia, friction, and other forces inherent in the selector gate assembly, but also the force supplied by the spring. Some have overcome the use of a spring in a selector gate assembly by utilizing direct current ("DC") or stepper motors to position the selector gate. These assemblies require that the motors be constantly energized, otherwise the selector gate may move due to vibrations inherent in document processing systems; vacuum, friction, and other forces imparted by the passing documents; and other such factors. Such movement may result in documents being routed to the incorrect pocket, resulting in errors.

SUMMARY

By contrast, the instant disclosure is directed to a pocket selector gate assembly that has a self-locking geometry. The self-locking geometry obviates the need for the spring, and thus allows smaller motors to be employed in the overall design. In some embodiments, the self-locking geometry comprises a link arm which allows the motor to rotate through greater than one hundred eighty (180) degrees, but less than a full revolution (i.e., 360 degrees). Because of the shape of the link arm and the associated gearing, the pocket selector gate assembly remains locked in place until the motor moves the assembly to a new position.

The disclosed selector gate assembly also allows the motor to be turned off when not actively moving the selector gate from one position to another. By allowing the motor to remain "off" most of the time, the disclosed pocket selector gate assembly reduces or eliminates the effects on surrounding equipment of the magnetic field generated by the motor when the motor is energized. This allows sensitive detectors, such as, without limitation, Magnetic Ink Character Recognition ("MICR") read heads, radio frequency identification ("RFID") readers, and the like, to be placed near the motors.

The smaller motor size and the ability to locate the detectors near the motor also permits the creation of an automated document processing apparatus ("ADP apparatus") which has a smaller footprint than traditional document processing machines.

In some embodiments, an exemplary automated document processing apparatus may comprise a detector; a plurality of pockets; and a pocket selector gate assembly which causes a document being processed by the apparatus to be routed to one of the plurality of pockets based on information read from the document by the detector, the route of the document being determined by the position of a pocket selector gate, the pocket selector gate position being controlled by a motor which is mechanically coupled to the pocket selector gate, the mechanical coupling being such that, when the pocket selector gate is in a first position, the pocket selector gate is locked in place even after the motor has been deenergized. In some embodiments, such locking may be achieved when the pocket selector gate is in either of the first or a second position. Some embodiments may use a link arm or other such mechanical coupling means to transfer the rotational force from the motor to a mating slot in the pocket selector gate. In some embodiments, the link arm, pin, and mating slot may be arranged such that the shaft cannot rotate a full three hundred sixty degrees, instead allowing the shaft to rotate in a range of between one hundred eighty and three hundred fifteen degrees.

Some embodiments may comprise an automated document processing apparatus comprising a detector; a first pocket; a second pocket; and, a pocket selector gate assembly, the pocket selector gate assembly causing a document being processed by the apparatus to be routed to the first pocket when a pocket selector gate is in a first position or the second pocket based when the pocket selector gate is in a second position, the pocket selector gate position being selected based on information read from the document by the detector, the pocket selector gate position being controlled by a motor which is mechanically coupled to the pocket selector gate by way of a link arm and a pin, the pin engaging a mating slot of the pocket selector gate, the mechanical coupling being such that, when the pocket selector gate is in either of a first position or a second position the pocket selector gate is locked in place even after the motor has been deenergized.

Additional features and advantages of the invention will be set forth in the description which follows, and in part will be apparent from this disclosure, or may be learned by practice of the invention. The objectives and other advantages of the invention will be realized and attained by the structure particularly pointed out in this written description, including any claims contained herein and the appended drawings.

It is to be understood that both the foregoing general description and the following detailed description are exemplary and explanatory and are intended to provide further explanation of the disclosed pocket selector gate with self locking geometry.

BRIEF DESCRIPTION OF THE DRAWINGS

The accompanying drawings, which are included to provide a further understanding of the disclosed pocket selector gate with self locking geometry and are incorporated in and constitute a part of this specification, illustrate various embodiments and, together with the description, serve to explain the principles of at least one embodiment of the disclosed pocket selector gate with self locking geometry.

In the drawings.

DETAILED DESCRIPTION

Reference will now be made in detail to embodiments of the disclosed pocket selector gate with self locking geometry, examples of which are illustrated in the accompanying drawings.

Figure 1:
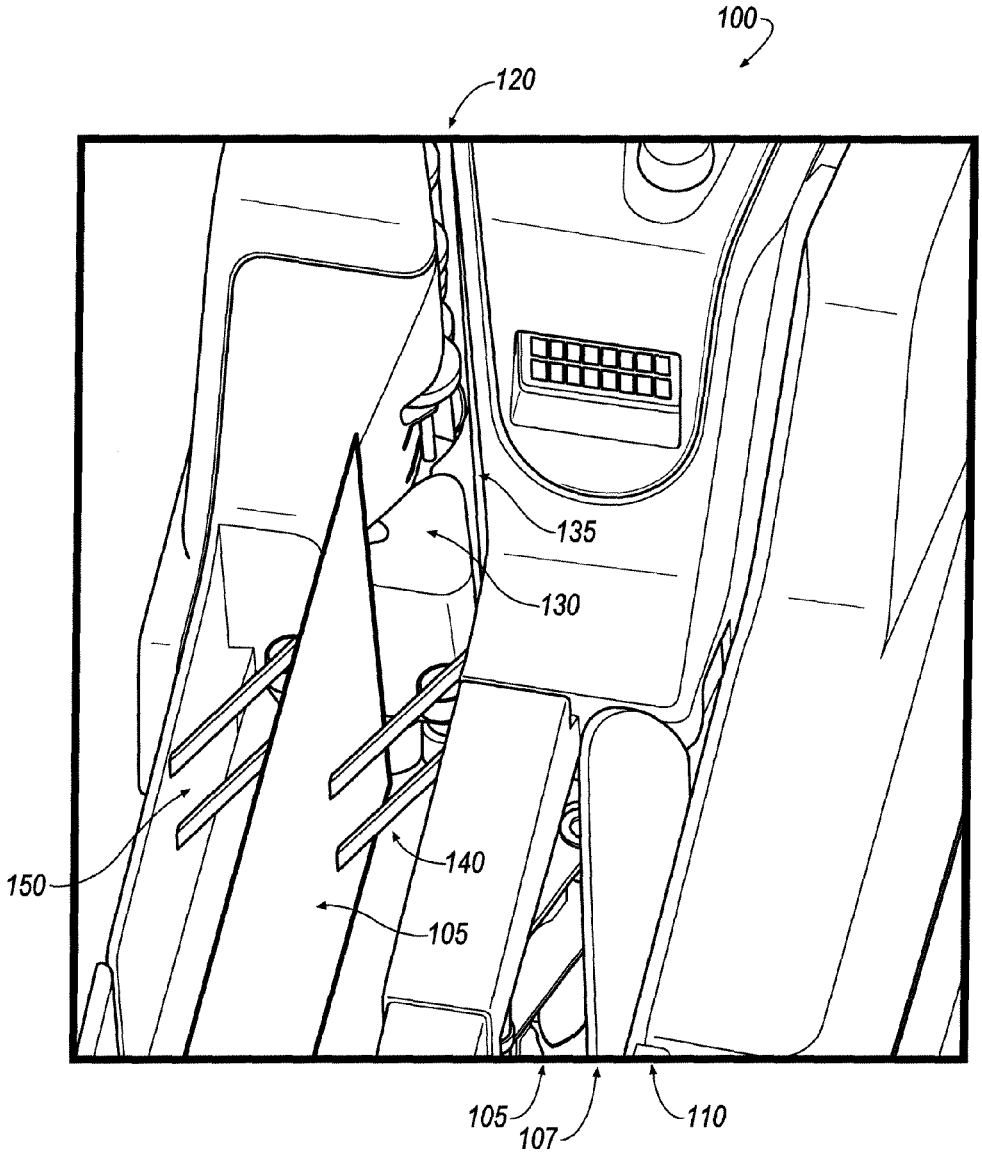
FIG. 1 is a top perspective view of an exemplary ADP apparatus.
Figure 2:
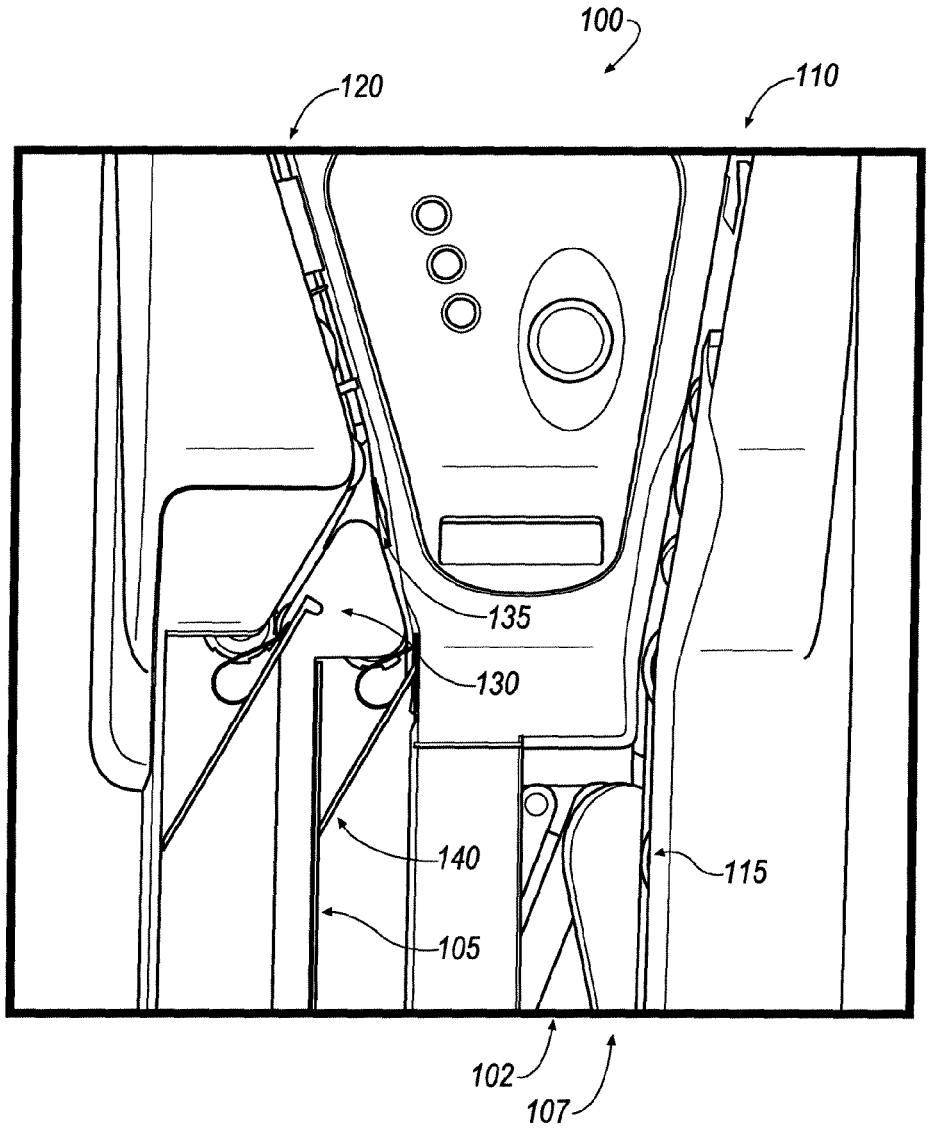
FIG. 2 is a top plan view of an exemplary ADP apparatus, illustrating a pocket selector gate routing documents to a selected pocket.

FIG. 1 is a top perspective view of an exemplary ADP apparatus 100, and FIG. 2 is a top plan view of a similar apparatus. An ADP apparatus may be used, for example, to process checks, incoming postal mail, or other documents 105. In FIG. 1, a document is inserted or fed into input slot 110, where it is carried around the body of the apparatus. During the document's travel, various aspects of the document are examined, with such aspects depending on the type of document being examined. ADP apparatus 100 uses the information obtained from the examination of document 105 to determine into which of a plurality of "pockets" 140, 150, the document should be routed. In the illustrated embodiment, a pocket selector gate 135 alters output path 120, thereby routing document 105 to the appropriate pocket within pocket selector gate assembly 130.

By way of example, without limitation, ADP apparatus 100 may be employed by a bank or other financial institution to process incoming checks. In such an exemplary use, unprocessed checks 105 can be loaded into hopper 102. Tension arm 107 applies pressure to the checks, and helps ensure that only a single check is picked up by traction wheels 115 for carriage through ADP apparatus 100. The check travels along input slot 110, where a variety of processes may be employed against it. By way of example, without limitation, rollers (not shown) may be used to smooth portions of the check to ensure a more accurate reading of the check. A light/sensor pair, radio frequency identification ("RFID") reader, electromagnetic reader, MICR reader, or other such device (referred to herein generally as a "detector") may be used to identify watermarks, RFID tags, magnetic strips, characters printed with ink comprising magnetic particles, handwritten or printed characters, or other such informational, authenticity, and/or identification indicia present on check 105. Based on the information read from check 105 and processing rules stored in ADP apparatus 100, the checks are routed to an appropriate pocket 140, 150. For example, in some applications of ADP apparatus 100, it may be advantageous to identify those checks which have previously been processed and to separate them from checks which have not yet been processed. This can be advantageous, for example, where piles of checks are accidentally co-mingled, where an operator is uncertain as to whether a particular check or groups of checks has been processed, or the like, thereby avoiding duplicate processing of the previously processed checks.

The accuracy, speed, and repeatability of selector gate 135's movement and position is crucial to the overall operation of ADP apparatus 100. More specifically, ADP apparatus 100 is limited to processing documents no faster than the time it takes for selector gate 135 to move from one position to another. If the documents were to come through ADP apparatus 100 at a higher speed, jams and/or misfiled documents are likely to result. Similarly, if selector gate 135 does not completely move to its anticipated position, or its position unexpectedly alters during the sorting process, jams and/or misfiled documents are likely to result. A pocket selector gate assembly similar to the embodiments described herein can allow selector gate 135 to rapidly move to a desired location, and to positively lock the selector gate once it is in the desired location, without the need to constantly energize motor 300.

As described above, by allowing motor 300 to be deenergized when the selector gate's position is static, the electromagnetic and radio frequency interference inherent in the operation of motor 300 can be essentially reduced and/or eliminated. This allows the detectors described above to be positioned closer to motor 300 than in conventional document processors, which means that the path taken by document 105 within the ADP apparatus can be shortened. This shortened path means that the documents can be run through ADP apparatus 100 faster, and may also result in the use of fewer traction wheels 115, thereby potentially decreasing the cost and mechanical complexity of the ADP apparatus.

Figure 3:
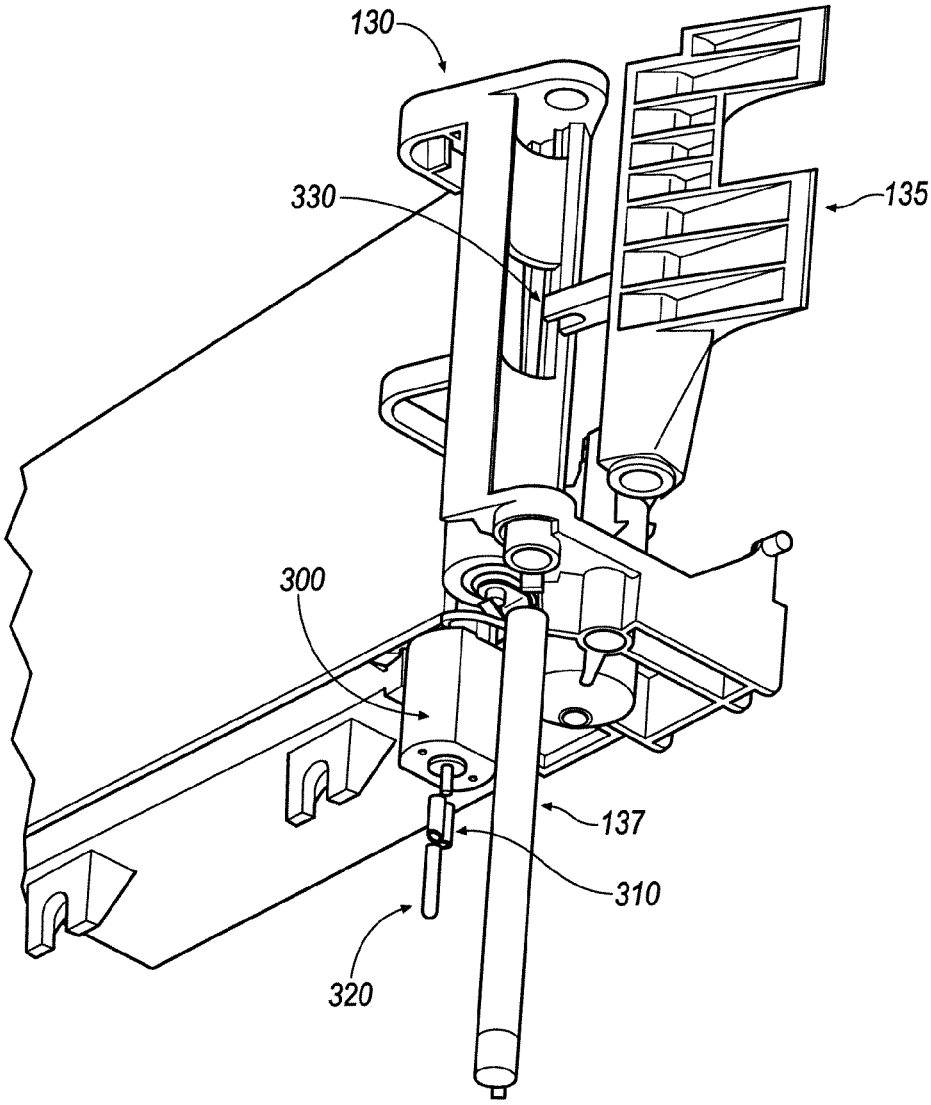
FIG. 3 is an exploded view of components of a pocket selector gate embodiment, as seen from the bottom.

As FIG. 3 illustrates, an embodiment of pocket selector gate assembly 130 comprises a motor 300 to which a link arm 310 is attached. Link arm 310, also known as an eccentric, mates with the shaft of motor 300. In some embodiments, the shaft may have a nominal diameter of approximately 0.0394 inches, and link arm 310 may comprise a hole or other opening of an approximately 0.0335 inches, thus facilitating a friction fit between link arm 310 and motor 300. When attached to motor 300, link arm 310 allows the rotational output of the shaft to be spread over a wider arc than that inherent in the shaft's motion.

Link arm 310 also receives pin 320, which translates the rotation of motor 300's shaft into a motion useful to move selector gate 135. In some embodiments, pin 320 may have a nominal diameter of approximately 0.0625 inches, and the hole or other opening into which pin 320 is fit into link arm 310 may have a nominal diameter of approximately 0.597 inches, thus facilitating a friction fit between the pin and the link arm.

Although illustrated as a plastic component that may be friction fit and/or bonded to the shaft of motor 300 and/or pin 320, in some embodiments, link arm 310 may be molded as part of, soldered, welded, or otherwise more permanently attached to the shaft and/or pin 320.

The exact length of link arm 310 can be chosen to facilitate the desired movement of selector gate 135. In some embodiments the length from the center of the hole that receives pin 320 to the center of the hole that receives the shaft of motor 300 is approximately 0.075 inches.

Figure 4:
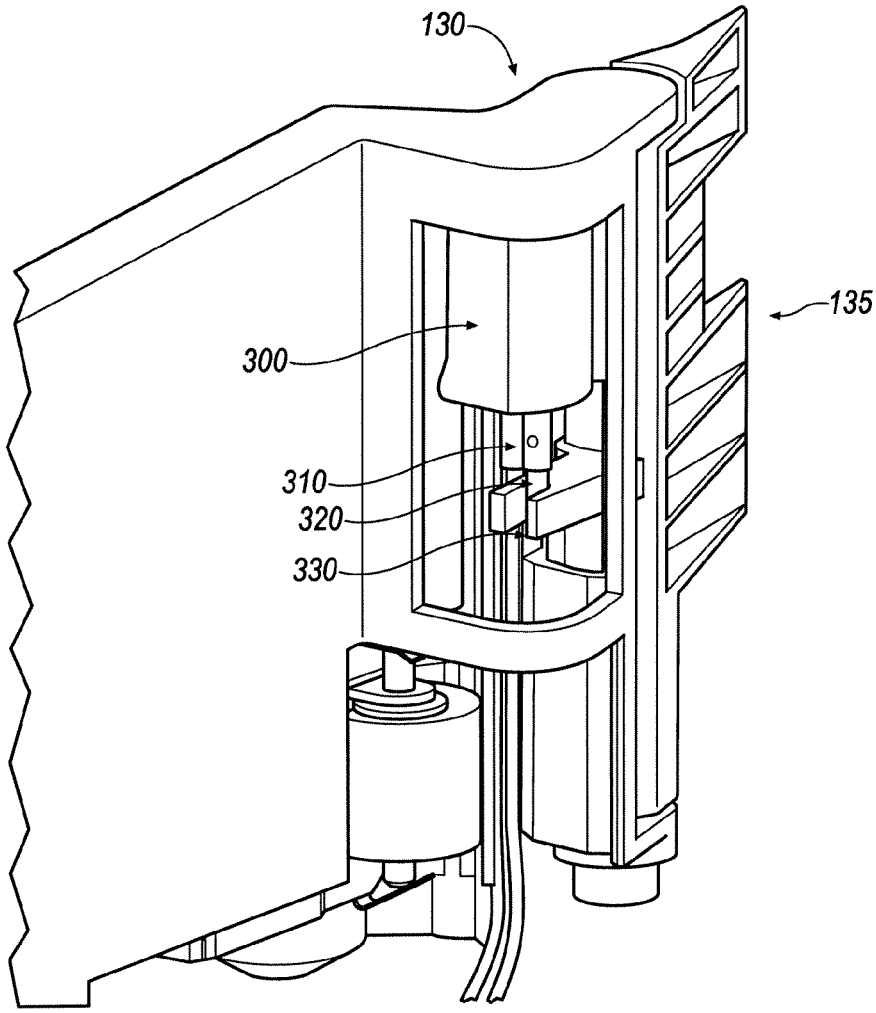
FIG. 4 is a side perspective view of a pocket selector gate embodiment.
Figure 5:
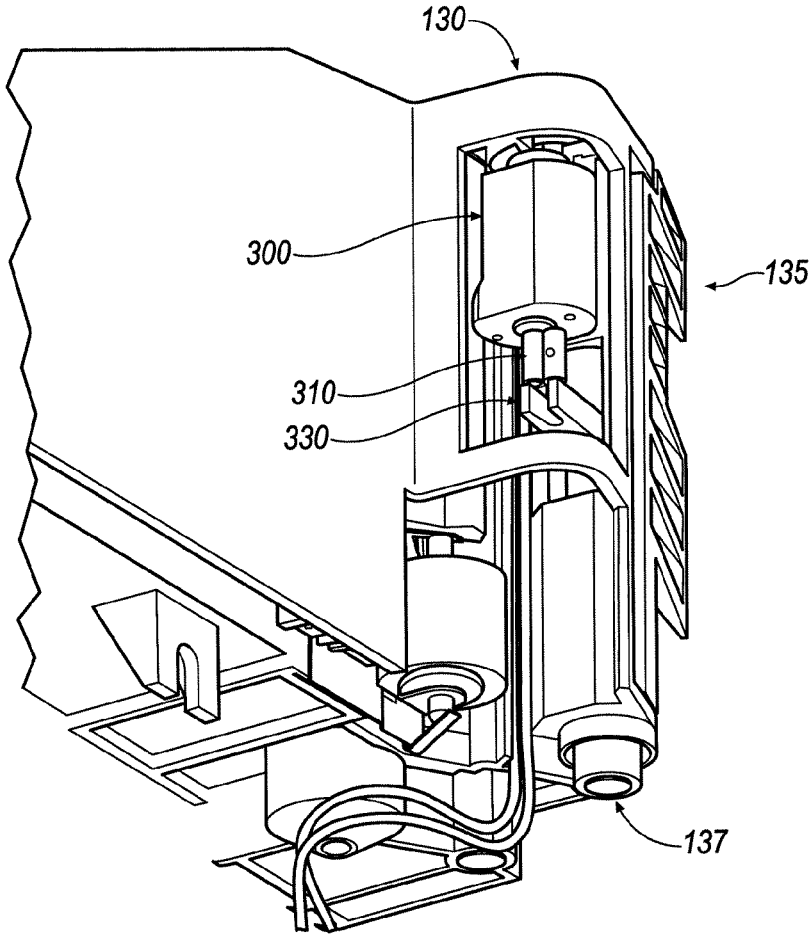
FIG. 5 is a bottom perspective view of a pocket selector gate embodiment.
Figure 6:
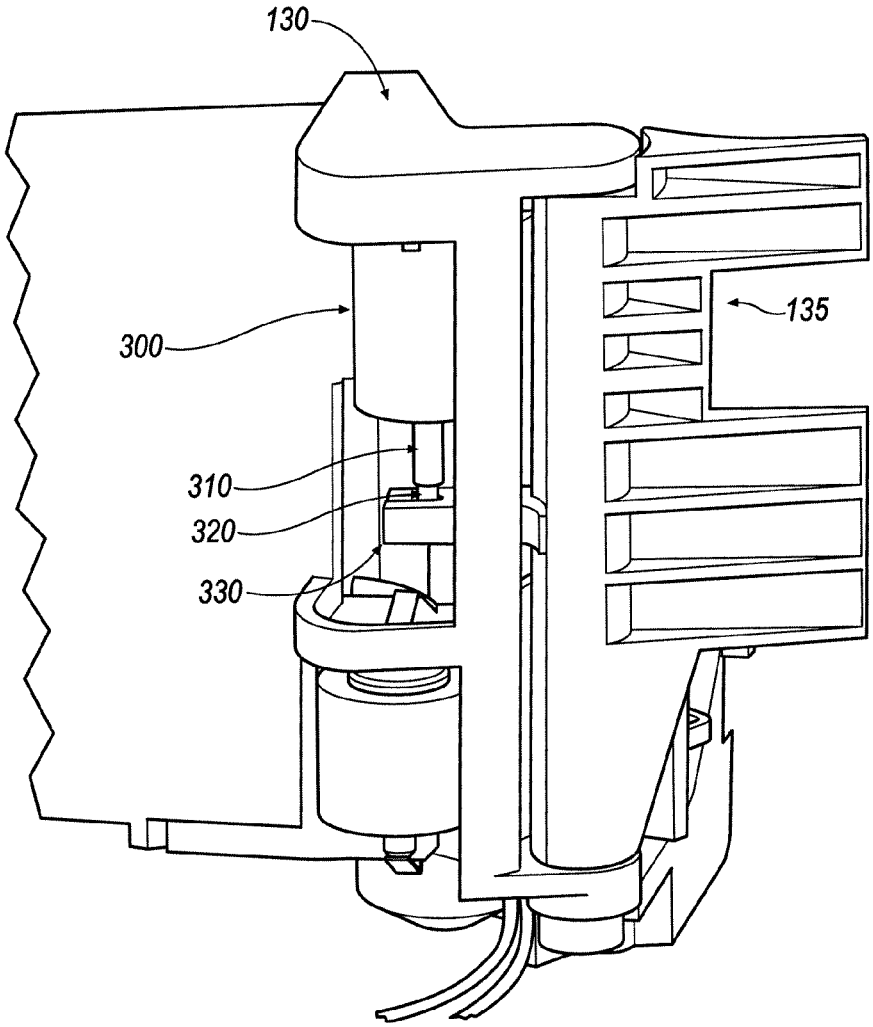
FIG. 6 is a side perspective view of a pocket selector gate embodiment.

When motor 300 is energized, it causes the shaft to rotate, which also causes link arm 310 and pin 320 to rotate. As FIGS. 4, 5, and 6 illustrate, when pocket selector gate assembly 130 is assembled, a hinge pin 137 attaches selector gate 135 to the pocket selector gate assembly, and provides a point around which selector gate 135 can rotate. Although motor 300 is illustrated as being installed with its axis of rotation parallel to that of hinge pin 137, in some embodiments motor 300 may be mounted such that its axis of rotation is perpendicular to hinge pin 137, or at other angles relative thereto, without deviating from the spirit or the scope of the invention.

As FIGS. 4, 5, and 6 further illustrate, when assembled, pin 320 is attached or otherwise mechanically coupled to link arm 310, which is mechanically coupled to motor 300, and pin 320 fits inside a mating slot 330 of selector gate 135. In some embodiments, motor 300 comprises a direct current ("DC") motor, wherein when the electrical polarity is reversed, the direction of the shaft's rotation reverses. In some embodiments, when assembled, mating slot 330 is arranged such that pin 320 stays within the confines of mating slot 330 over the entire course of its travel. In some embodiments, slot 330 may be replaced with a groove or other such opening within selector gate 135.

Figure 7:
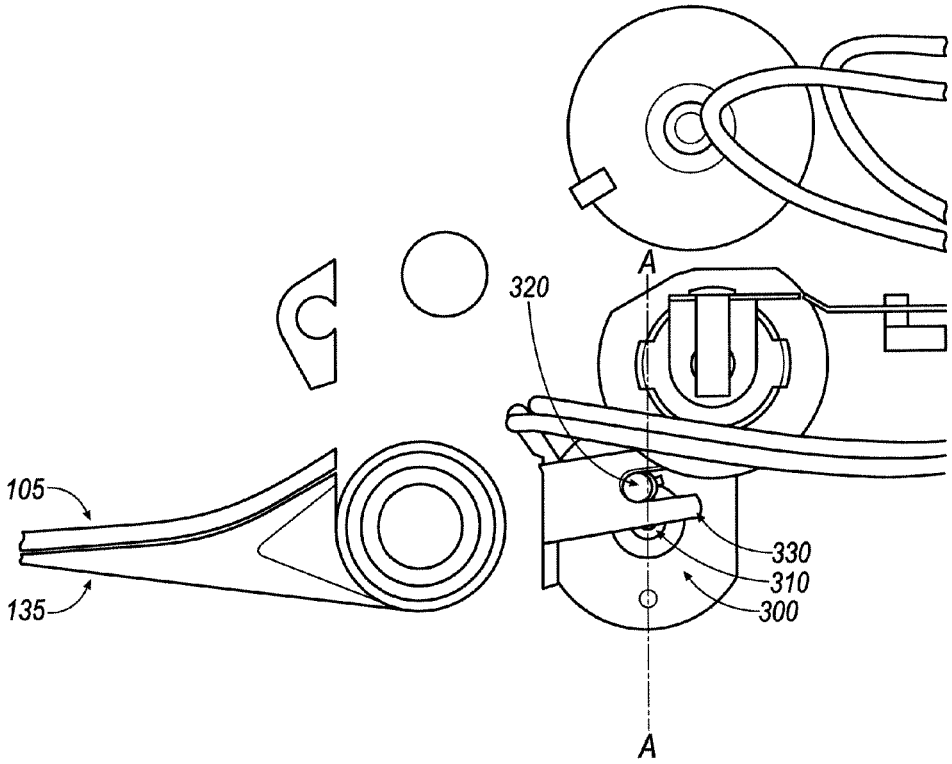
FIG. 7 is a bottom plan view of a pocket selector gate embodiment with the selector gate in a first position.
Figure 8:
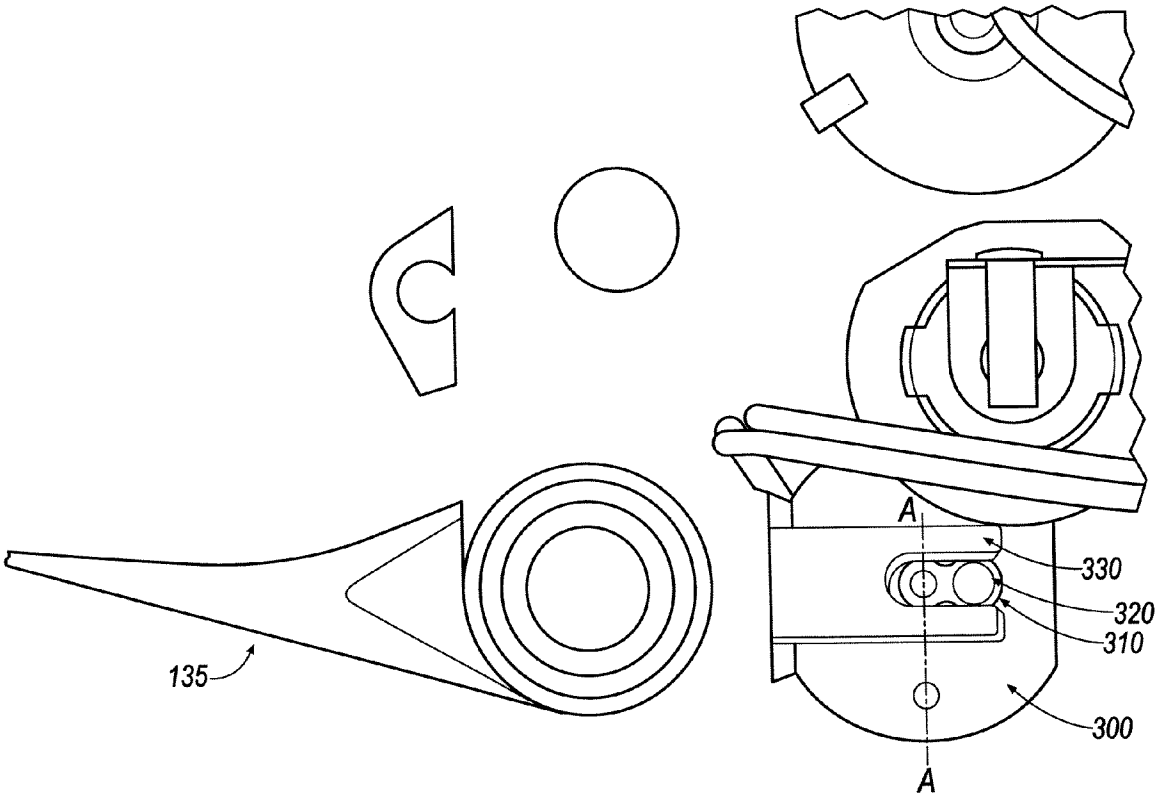
FIG. 8 is a bottom plan view of a pocket selector gate embodiment with the selector gate in a second, intermediate position.
Figure 9:
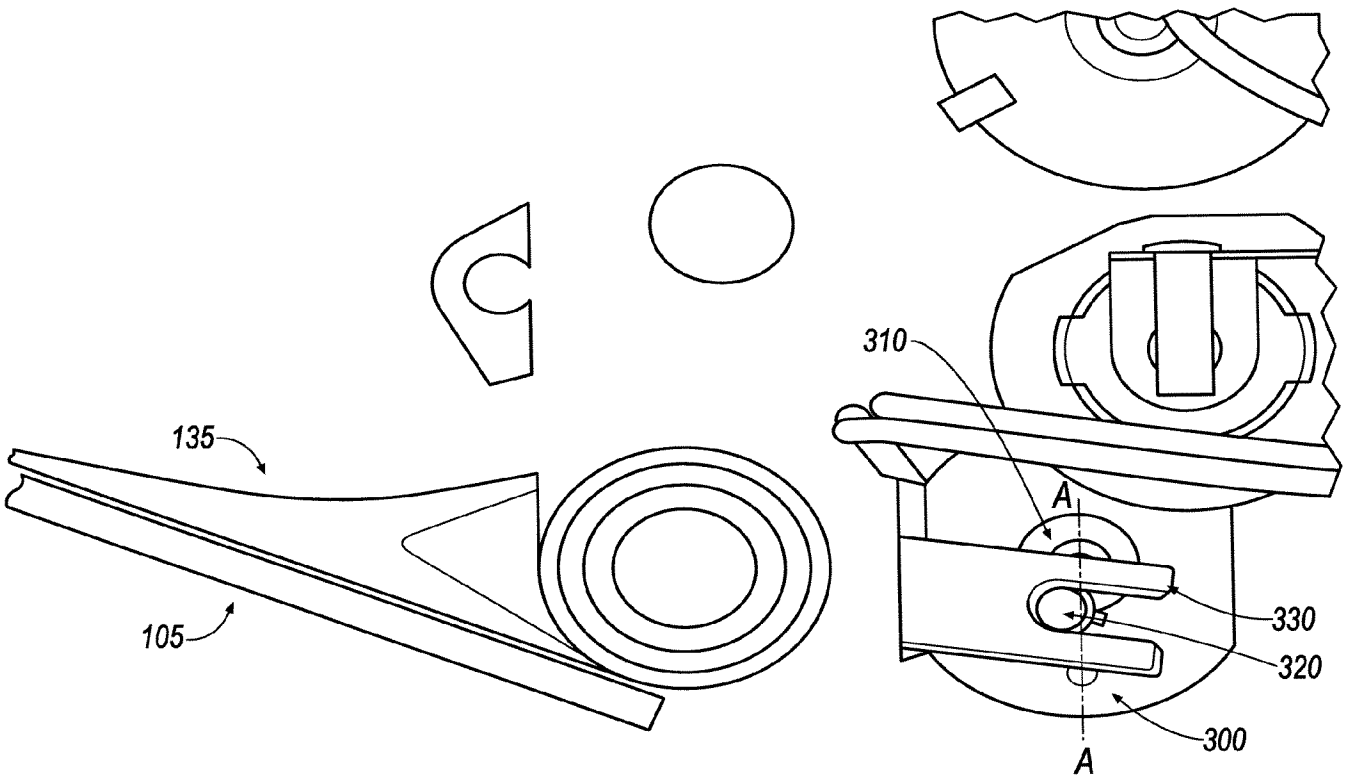
FIG. 9 is a bottom plan view of a pocket selector gate embodiment with the selector gate in a third position.

FIGS. 7, 8, and 9 illustrate the movement of selector gate 135 which results from the movement of motor 300, and the corresponding rotation of link arm 310 and pin 320. FIG. 7 illustrates motor 300 in a first position, and the resulting orientation of selector gate 135. When selector gate 135 is in such an orientation, the tip of the selector gate may be positioned flush with, nearly flush with, or recessed into the wall of output path 120, thereby facilitating a relatively clear path through which document 105 can travel into pocket 150 without jamming. As document 105 travels along selector gate 135, the forces associated with the document generally press the selector gate further into the wall, thus obviating the need to further restrict the selector gate's movement in that direction. However, as document 105 moves along selector gate 135, some vacuum and friction forces may be created which exert a force that pulls the selector gate away from the wall.

To help limit the movement of selector gate 135 while in the first position, mating slot 330 is of a width nominally larger than the diameter of pin 320. This allows pin 320 to move freely along mating slot 330 when motor 300 is energized, while limiting undesirable lateral movement of mating slot 330 while selector gate 135 is in the first position. By way of example, without limitation, in an embodiment in which pin 320 is approximately 0.0625 inches in diameter, mating slot 330 may be approximately 0.065 inches wide.

Mating slot 330, pin 320, and link arm 310 are also generally designed such that when motor 300 is in the first position, the center of pin 300 is beyond the mid-point of motor 300's rotation, represented as line A-A in FIG. 7. Thus, as document 105 feeds past selector gate 135, any forces that pull the selector gate away from the wall will cause pin 320 to rotate inward, pressing against the end of mating slot 330, and thus effectively locking selector gate 135 into the first position. In some embodiments, the arrangement of pin 320, mating slot 330, and link arm 310 is such that the shaft of motor 300 cannot rotate a full three hundred sixty (360) degrees. By way of example, without limitation, in some embodiments the shaft may be limited to a maximum rotation of greater than approximately one hundred eighty (180) degrees, but less than approximately three hundred fifteen (315) degrees. In some embodiments, it may be advantageous to limit the rotation to less than approximately two hundred twenty-five (225) degrees, as this can allow pin 320 to be appropriately positioned while keeping relatively short the distance the pin needs to travel, thus allowing selector gate to move from the first position to a second position as quickly as possible. In some embodiments, it may be advantageous to limit the rotation to approximately fifteen (15) to twenty (20) degrees beyond top dead center of motor 300 at each end of the link arm's travel.

FIG. 8 illustrates motor 300 as it moves from the first position illustrated in FIG. 7 to the second position illustrated in FIG. 9. In some embodiments, selector gate 135 may rotate a total of approximately twenty-four (24) degrees as a result of the movement of link arm 310 and pin 320.

In the embodiment illustrated in FIG. 9, the orientation of pin 320 causes selector gate 135 to be positioned against, flush with, or recessed into, the opposite wall of output slot 120, thereby diverting documents into pocket 140. As described above with respect to FIG. 7, when motor 300 is in the second position, pin 320 is beyond the mid-point of motor 300's rotation, effectively locking selector gate 135 into this second position.

Because pin 300 locks selector gate 135 into position, motor 300 need not be energized except when selector gate 135 is being moved from one position to another. This can help reduce the overall power consumption of ADP apparatus 100. Still further, as described above, with the obviation of the interference associated with energizing motor 300, sensors and other, related devices can be placed closer to motor 300, thereby reducing the overall size of ADP apparatus, and potentially increasing the speed at which documents can be processed.

While detailed and specific embodiments of the pocket selector gate with self locking geometry have been described herein, it will be apparent to those skilled in the art that various changes and modifications can be made therein without departing from the spirit and scope of the pocket selector gate with self locking geometry. Thus, it is intended that the present disclosure cover these modifications and variations provided they come within the scope of any appended claims and/or their equivalents.

What is claimed is:

1. An automated document processing apparatus comprising:

a detector;

a plurality of pockets; and, a pocket selector gate assembly, the pocket selector gate assembly causing a document being processed by the apparatus to be routed to one of the plurality of pockets based on information read from the document by the detector, the route of the document being determined by the position of a pocket selector gate, the pocket selector gate position being controlled by a motor, a link arm and a pin which is mechanically coupled to a mating slot of the pocket selector gate, the mechanical coupling being such that, when the pocket selector gate is in a first position, the pocket selector gate is locked in place in the first position even after the motor has been deenergized due to the pin being on a first side of a mid-point of the motor, and when the pocket selector gate is in a second position, the pocket selector gate is locked in place in the second position even after the motor has been deenergized due to the pin being on the other side of the mid-point of the motor.

2. The apparatus of claim 1, the detector comprising at least one of an MICR detector, an RFID detector, and an optical character recognition detector.

3. The apparatus of claim 1, the plurality of pockets comprising two pockets.

4. The apparatus of claim 3 wherein, when the selector gate is in the first position, the document is routed to a first of the two pockets.

5. The apparatus of claim 1, the link arm, pin, and mating slot being arranged such that the shaft cannot rotate a full three hundred sixty degrees.

6. The apparatus of claim 5, the shaft being capable of rotating greater than one hundred eighty degrees.

7. The apparatus of claim 6, the shaft being capable of a maximum rotation of between one hundred eighty-one and three hundred fifteen degrees.

8. An automated document processing apparatus comprising:

a detector;

a first pocket;

a second pocket; and, a pocket selector gate assembly, the pocket selector gate assembly causing a document being processed by the apparatus to be routed to the first pocket when a pocket selector gate is in a first position or the second pocket based when the pocket selector gate is in a second position, the pocket selector gate position being selected based on information read from the document by the detector, the pocket selector gate position being controlled by a motor which is mechanically coupled to the pocket selector gate by way of a link arm and a pin, the pin engaging a mating slot of the pocket selector gate, the mechanical coupling being such that, when the pocket selector gate is in either of a first position or a second position the pocket selector gate is locked in place even after the motor has been deenergized, wherein the motor has a mid-point, and wherein the pin resides on a first side of the mid-point of the motor in the first position and a second side of the mid-point of the motor in the second position.

9. The apparatus of claim 8, the detector comprising at least one of an MICR detector, an RFID detector, and an optical character recognition detector.

10. The apparatus of claim 8, the link arm, pin, and mating slot being arranged such that the shaft cannot rotate a full three hundred sixty degrees.

11. The apparatus of claim 10, the shaft being capable of rotating greater than one hundred eighty degrees.

12. The apparatus of claim 11, the shaft being capable of a maximum rotation of between one hundred eighty-one and three hundred fifteen degrees.

13. A document processing apparatus comprising:

a pocket selector gate assembly having a motor connected to a link arm and having a pin extending therefrom; and a pocket selector gate having a mating slot movably connected to the pin of the pocket selector gate assembly, wherein the link arm is an over center arm and retains the pocket selector gate in the first position when the over center arm is on a first side of a center position and the second position when the over center arm is on a second side of a center position, when the motor is not energized.

* * * * *